US006099545A

United States Patent [19]

Mann et al.

[11] Patent Number: 6,099,545

[45] Date of Patent: Aug. 8, 2000

[54] TRAP DOOR STUD APPLICATOR EAR PIERCING CARTRIDGE ASSEMBLY

[75] Inventors: Samuel J. Mann, Engelwood; Charles Kowalski, Ridgewood, both of N.J.

[73] Assignee: Cookson Group PLC, United Kingdom

[21] Appl. No.: 09/444,854

[22] Filed: Nov. 22, 1999

Related U.S. Application Data

[63] Continuation-in-part of application No. 09/288,907, Apr. 9, 1999.

[51] Int. Cl.[7] ..... A61B 17/34

[52] U.S. Cl. ..... 606/188

[58] Field of Search ..... 606/188, 185, 606/181, 117

[56] References Cited

U.S. PATENT DOCUMENTS

| | | | |
|---|---|---|---|
| 3,943,935 | 3/1976 | Cameron . | |
| 4,020,848 | 5/1977 | DiCicco . | |
| 4,030,507 | 6/1977 | Mann . | |
| 4,516,577 | 5/1985 | Scott et al. | 606/188 |
| 4,527,563 | 7/1985 | Reil . | |
| 4,931,060 | 6/1990 | Ave . | |
| 5,004,470 | 4/1991 | Mann . | |
| 5,004,471 | 4/1991 | Mann . | |
| 5,007,918 | 4/1991 | Mann . | |
| 5,211,653 | 5/1993 | Nakajima | 606/188 |
| 5,263,960 | 11/1993 | Mann . | |
| 5,350,394 | 9/1994 | Mann . | |
| 5,360,434 | 11/1994 | Mann . | |
| 5,441,574 | 8/1995 | Durham . | |
| 5,496,343 | 3/1995 | Reil . | |
| 5,499,993 | 3/1996 | Blomdahl et al. . | |
| 5,690,665 | 11/1997 | Mann . | |
| 5,925,057 | 7/1999 | Blomdahl | 606/188 |

*Primary Examiner*—Michael Buiz
*Assistant Examiner*—Kevin Truong
*Attorney, Agent, or Firm*—Weingram & Associates, P.C.

[57] ABSTRACT

A disposable ear piercing device includes a first disposable cartridge containing an earring head of a stud or straight post configuration. An inner slidable capsule and a slidable spacer within the capsule hold the decorative earring head and post within the cartridge. A second clutch cartridge spaced from the slidable capsule holds a closed end clutch. A spring biased plunger controlled by a trigger release actuates the slidable spacer and capsule within the first cartridge to project the earring head through the earlobe in an open saddle area. The clutch at the opposing saddle area receives and engages the earring stud or post. Release mechanisms on the capsule and clutch cartridge permit removal of the earlobe with the earring away from the instrument.

16 Claims, 8 Drawing Sheets

TRAP DOOR STUD APPLICATOR EAR PIERCING CARTRIDGE ASSEMBLY

This application is a continuation-in-part of Ser. No. 09/288,907 filed Apr. 9, 1999, now pending.

BACKGROUND OF THE INVENTION

1. FIELD OF THE INVENTION

The present invention relates to an ear piercing system capable of inserting odd shaped decorative headed earrings having stud piercers with stepped shafts of various thicknesses or straight post piercers. A disposable cartridge retains a stud or straight post earring in a spring actuated ear piercing instrument. A locking clutch within another cartridge engages the earring shaft.

Previous ear piercing instruments have been limited to either stud piercers or straight posted piercers. Stud earrings have been used with solid shaped essentially round profiles machined to form a stepped post. The smaller diameter portion includes the piercing point and the larger diameter portion holding the decorative head forms a larger hole in the ear than conventional straight post piercers. Examples of such prior art piercing devices are found in the following patents.

2. DESCRIPTION OF THE RELATED ART

U.S. Pat. No. 4,931,060 to Aué discloses a spring actuated is ear lobe piercing device using a cartridge having flexible jaws at the exit end which retain the stud. The jaws expand outwardly and break off due to the pressure of the symmetrical head of the stud.

U.S. Pat. No. 5,004,470 to Mann discloses an ear lobe piercing instrument containing a horizontally slidable releasable stud cartridge containing two stepped studs and a horizontally slidable releasable clutch capsule holding two capsules. Each stud is retained in a capsule and driven from its container by a spring operated plunger. The cartridge and capsule are then displaced horizontally for the second piercing.

U.S. Pat. No. 5,360,434 to Mann discloses a manually operated stud piercer in which two stepped studs and clutches are disposed horizontally. After the first stud is engaged, a switchable button on the side of the instrument is depressed to move the plunger push rod to the adjacent stud for piercing.

U.S. Pat. No. 5,441,514 to Durham discloses a cartridge for an ear piercing apparatus including a clasp holding member of a stud assembly and a stud holding member, complimentary guides to facilitate longitudinal movement of the members, a slot within the clasp holding member for receipt of the clasp, and retaining means for engagement with the clasp.

U.S. Pat. No. 5,496,343 to Reil discloses an ear piercing instrument with an earring and nut in opposing jaws. Hand squeezing causes a frangible tab to break and accelerate the earring to pierce the ear lobe and engage the earring jaw. A flexible tang expels the earring cartridge. A flexible finger holds the lower curl spring of the earring nut in place until the ear is pierced.

U.S. Pat. No. 5,449,993 to Blomdahl et al concerns an ear piercing apparatus including a pistol having a disposable cassette, a hand grip and a spring biased plunger. The cassette includes a stud housing cooperating with the plunger and a back clasp housing. A guide member extends from the back clasp and passes through the stud housing. A positioning means and lever provide axial movement of the stud and back clasp housings. The pistol ejects the stud to penetrate the ear lobe and engage the clasp, with the spent cassette being removed and discarded.

U.S. Pat. No. 5,690,665 to Mann discloses a spring operated ear piercing instrument having a rotatable stud cartridge with two studs and a rotatable clutch cartridge with two clutches. A stepped stud is retained by a stop. Actuation of a spring plunger drives a first stud through the ear and into the first clutch. The cartridges containing the next stud and clutch are rotated 180° for alignment with the plunger for the next insertion.

U.S. Pat. No. 5,925,057 to Blomdahl concerns an ear piercing by, apparatus having a slidable clutch assembly which ensures that an attachment position of the clutch on the piercing pin is adjusted to the thickness of the ear. The position of the clutch can be locked prior to ejecting the pin into the clutch. The ear piercing pin has an enlarged head portion tailored to the shape of the inside of an openable holder to firmly hold the head during the piercing. The holder front is opened by a chamfered edge on the clutch assembly. Jaw members on the holder may engage the edge to open the jaws.

While many variations of ear piercing devices are known, these have generally been quite complex, difficult to use, subject to contamination and limited in the type of stud or post and design of the decorative earring that can be employed.

OBJECTS AND SUMMARY OF THE INVENTION

It is therefore a primary object of the present invention to provide an ear piercing device which permits use of a variety of decorative earring head styles and clutches with either stud type or straight post type piercers.

It is a further object of the invention to provide a simplified ear piercing device which reduces the necessary handling of the various components.

It is a still further object of the invention to provide an ear piercing device which can be used with symmetrical and nonsymmetrical decorative earring heads of varying sizes and thicknesses.

Yet another object of the invention is to provide an ear piercing device which provides a safe secure connection between the stud or straight post earring and clutch.

A still further object of the invention is to provide an ear piercing device that reliably and accurately positions the earrings.

Another object of the invention is to provide an ear piercing device which is inexpensive, durable and easily stored.

Still another object of the invention is to provide an ear piercing device which enables easy removal from the earlobe after insertion of the earring.

It is another object of the invention to provide a sterile disposable cartridge containing the decorative head earring.

An additional object of the invention is to provide a unique disposable cartridge having an inner slidable capsule containing the decorative head stud or straight post earring and a slidable spacer within the capsule to project the stud or straight post through the earlobe into a clutch held in an opposing sterile cartridge.

It is also an object of the present invention to provide a release mechanism on the slidable capsule and spacer to permit removal from the earlobe and attached earring from the clutch cartridge.

An added object of the invention is to provide a clutch cartridge that is retained within a clutch holder frame of the piercing instrument.

These objects are achieved with a novel ear piercing device having a first disposable cartridge containing an earring head of a stud or straight post configuration. An inner slidable capsule and slidable spacer hold the decorative earring head within the cartridge. A second clutch cartridge spaced from the slidable capsule holds a closed end clutch. A spring biased plunger controlled by a trigger release actuates the slidable spacer and capsule within the first cartridge to project the earring head through the earlobe in an open saddle area. The clutch at the opposing saddle area receives and engages the earring stud or post. A release mechanism on the capsule permits removal of the earlobe with the earring away from the instrument.

Other objects and advantages will become apparent from the following description in conjunction with the accompanying drawings.

BRIEF DESCRIPTION OF THE DRAWINGS

For a more complete understanding of the present invention, reference may be had to the following description of exemplary embodiments of the present invention considered in connection with the accompanying drawings, in which.

DETAILED DESCRIPTION OF THE PREFERRED EMBODIMENTS

Figure 1:
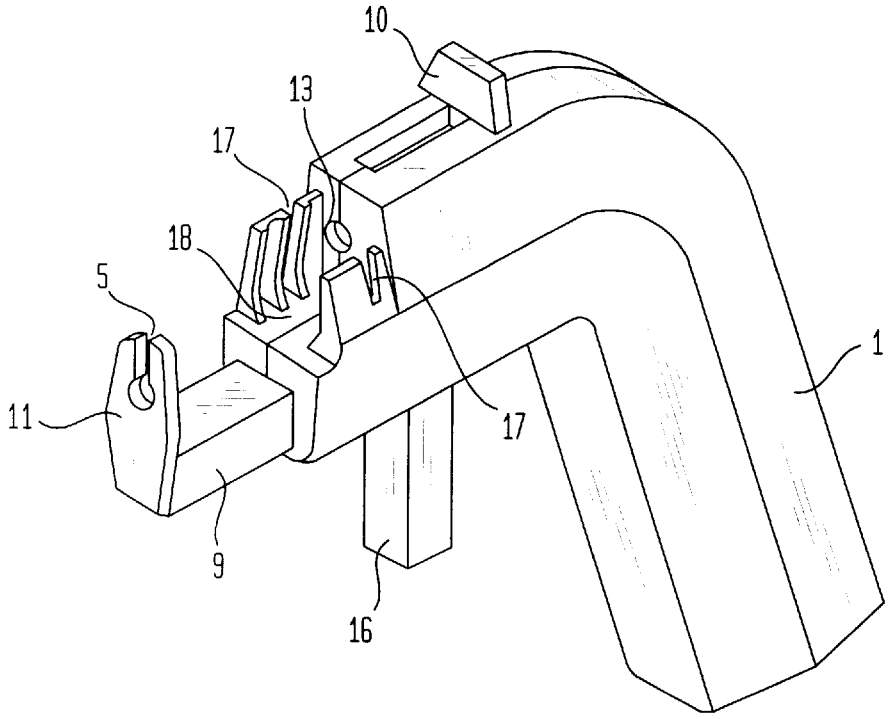
FIG. 1 is a generalized perspective view of the instrument body before insertion of the cartridges.

As shown in FIG. 1, the present invention includes an ear piercing instrument such as generally described in U.S. Pat. No. 5,690,665 which provides a platform for the invention, but use is not limited to this instrument. The instrument in the prior patent employs a dual arrangement for holding two earring heads and clutches while the present configuration is used with only one earring head and clutch.

Figure 2:
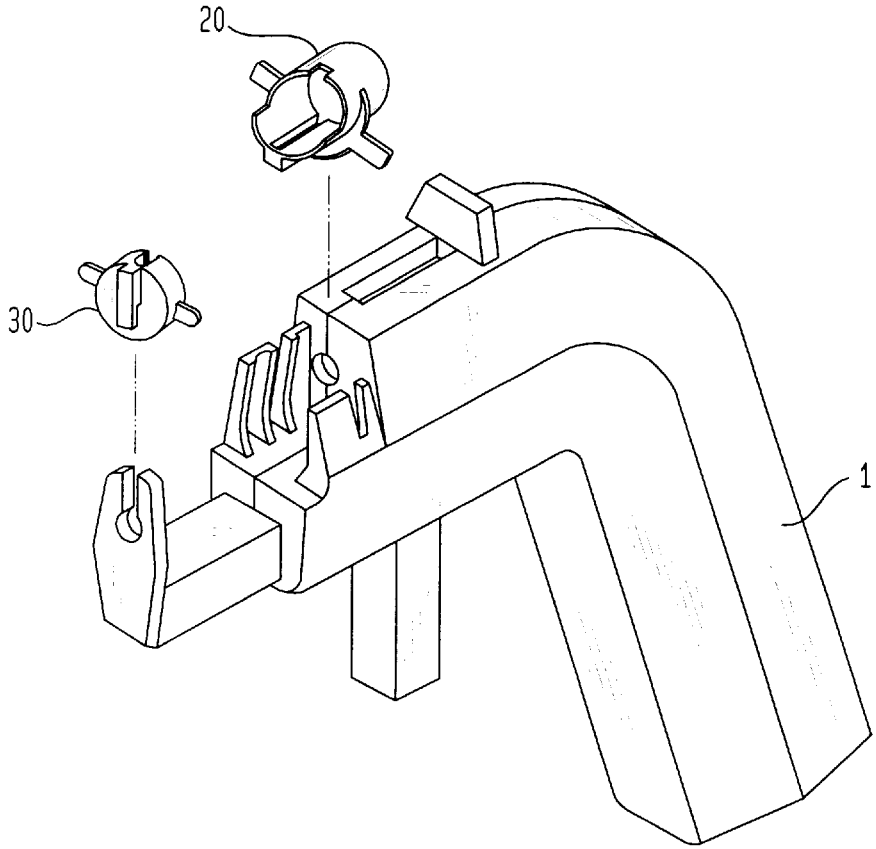
FIG. 2 is a generalized perspective view of the instrument showing the cartridges positioned for insertion.
Figure 3:
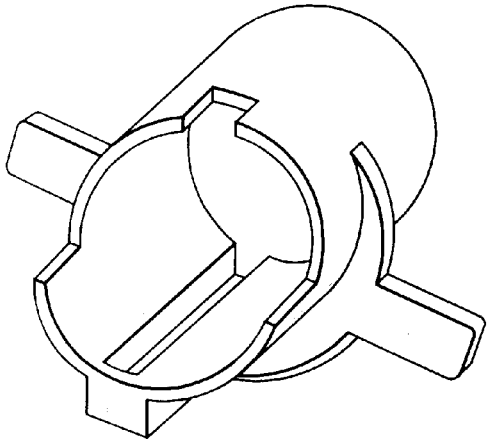
FIG. 3 is a perspective view of the outer cartridge which receives the capsule holding the earring head.

The piercing process commences with the removal of the disposable sterile earring cartridge 20 and the sterile clutch cartridge 30, as shown in FIG. 2, from a sterilized container. The cartridge 20 bears two extension arms 22 and 23, shown in FIG. 5, whose purpose is to retain the cartridge assembly in the instrument 1 and aid insertion into the instrument within retaining channels 17 located on side walls providing a channel 18 receiving cartridge 20, as shown in FIGS. 1 and 2.

Figure 4:
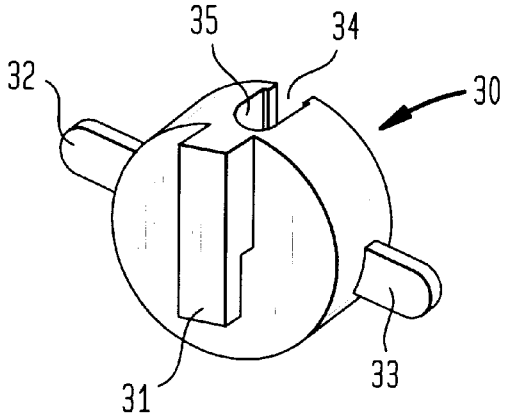
FIG. 4 is a rear perspective view of the clutch holder.

Clutch cartridge 30 is next inserted into the clutch holder bracket 11 which in turn is connected to the trigger assembly 16 by extension 9 and is displaced towards the cartridge 20 by compression of the trigger 16. The clutch, as shown in FIGS. 10–14 is of such construction as to be retained by clutch cartridge 30 having a retainer 31 as shown in FIG. 4, which is positioned into channel 5, shown in FIG. 1, and retained. Cartridge 30 is provided with extension arms 32 and 33 whose purpose is to assist in handling the insertion of the cartridge into the clutch holder 11 and provide a means to remove the cartridge from the instrument after completing the piercing. Clutch cartridge 30 provides an opening 34 through which the earring post must pass. Pocket 35 provides the receptacle for the clutch 70 or 75, FIGS. 10–14. Several styles of clutches will be utilized in the invention. Pocket 35 is of a shape to conform to the geometry of the clutch itself to provide security and releasability.

Figure 15:
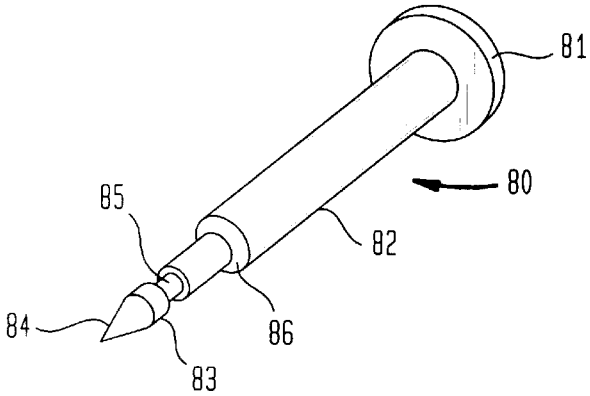
FIG. 15 is a perspective view of a stud earring.

FIG. 15 represents the stud earring 80 and its features. The ornamental head 81 consists of a symmetrical or non-symmetrical profile joined to the end of post 82. The diameter of shaft portion 82 is larger than shaft portion 83 which features a piercing point 84. Shaft 83 includes a locking undercut groove 85 which will engage the locking mechanism of the clutch. The transition from shaft portion 83 to shaft portion 82 may be a taper 86 or may be sharp. The transition portion 86 prevents the clutch from engaging past this point to maintain a comfortable fit of the earring on the lobe without excessive compressive force on the lobe.

Figure 16:
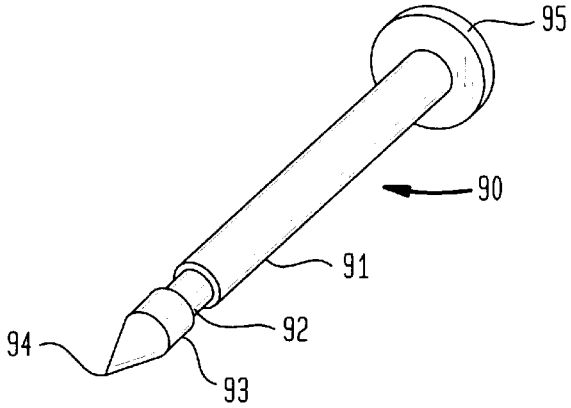
FIG. 16 is a perspective view of a straight post earring.

FIG. 16 shows a straight post earring 90 which consists of a symmetrical or non-symmetrical decorative head 95 of varying thickness attached to a straight post 91 which has a smaller diameter undercut 92, a point 94 and a straight portion 93 of the same diameter as portion 91. The cartridge 20, FIG. 5, consists of a horizontal opening 21 which receives the inner capsule 40. Extension arms 22 and 23 of cartridge 20 allow the operator to firmly hold and insert the cartridge into the channels 17, FIGS. 1 and 2. Cut back surfaces 24 on the sides of the cartridge are provided for the purpose of allowing the pivotable doors 41 and 42, FIG. 7, of the inner capsule 40 to open. Aperture 25 located on the upper surface is provided for viewing the point of the earring prior to insertion, allowing the operator to place the earring at a desired location on the ear. Channel 26 located on the lower surface of the cartridge provides a means to orient the inner capsule 40 so that doors 41 and 42 will open upon completion of the piercing.

Figure 7:
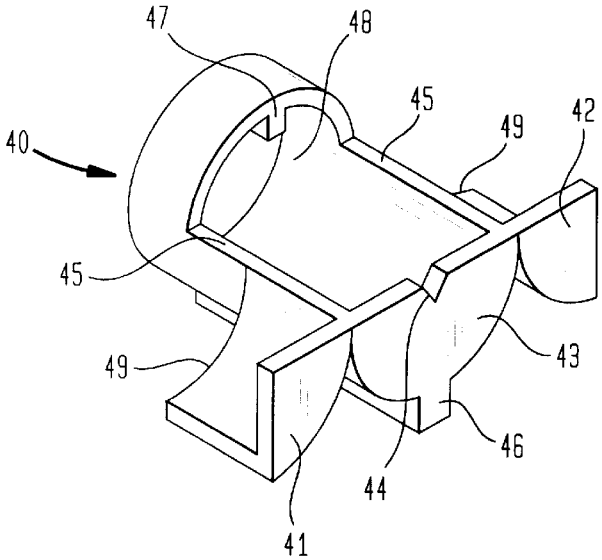
FIG. 7 is a front perspective view of the capsule with open hinged doors.

Inner capsule 40, FIG. 7 consists of a hollow horizontal cylinder with a closure wall 43 at the end of the bore 48. Wall 43 occupies half the diameter of the cylinder and is provided with an opening 44 for the earring post. Capsule 40 is provided with doors 41 and 42 which are attached to the body of the capsule by hinges 45. The hinges may be fabricated in the same body as the capsule or may include separate unhinged doors attached with clips, tape, or adhesive to provide a pivotable mechanism for individual doors. Lower extension 46 is of such shape to align with the channel 26 of the capsule 20. Bore 48 includes rib 47 on the upper inside for aligning the slidable spacer, FIG. 8.

Figure 6:
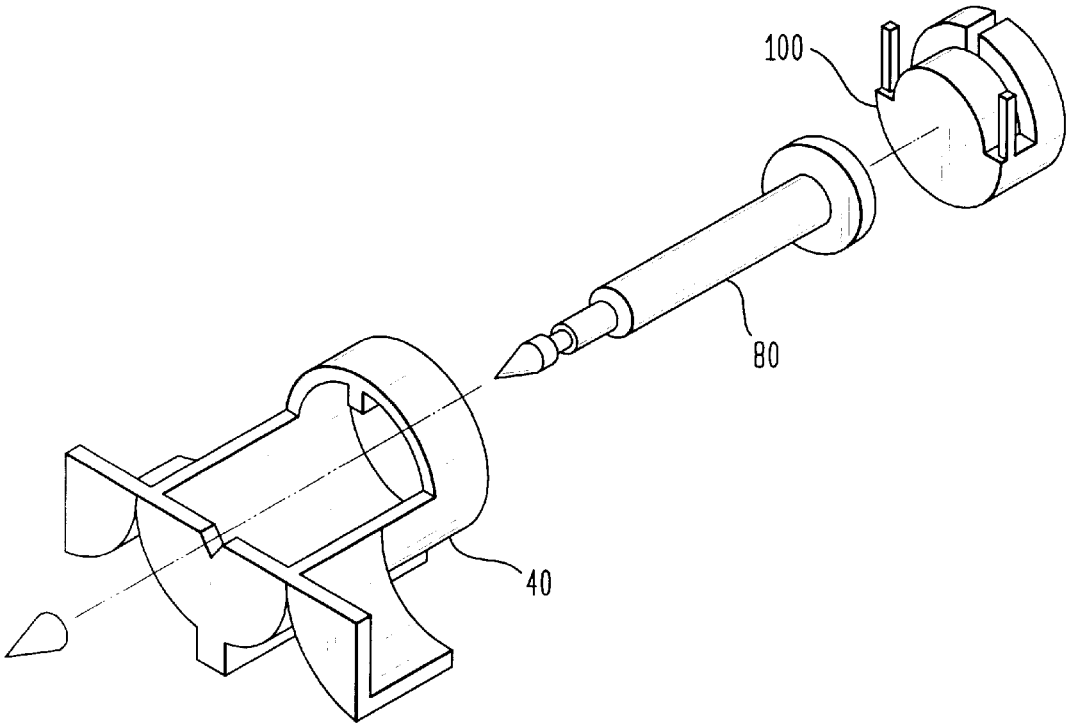
FIG. 6 is an exploded perspective view of the capsule in the open position and the earring and slidable spacer held within the capsule.
Figure 6A:
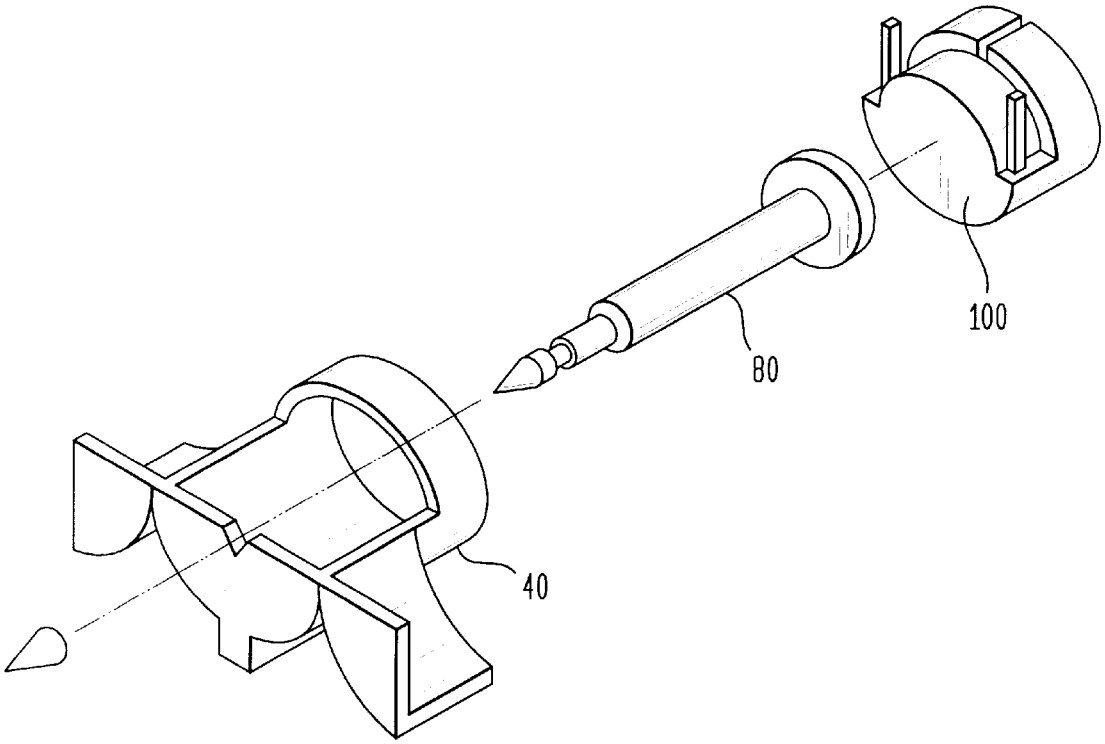
FIG. 6A is an exploded view of the open capsule, earring and a slidable spacer having an oblate shape conforming to a like shaped capsule.

Slidable spacer 100 consists of a cylinder of such length to provide for the various earring head heights and of such diameter to fit into the capsule 40. Channel 103 located on the top surface provides alignment with rib 47 of capsule 40. The inside shape of the capsule 40 and the outside shape of the slidable spacer 100 need not be circular but may consist of other conformal shapes such as an oblate shape as in FIG. 6A. Arms 101 and 102 are flexible and springable so that when folded down to the body 100 the arms return to the initial upright position when released. The arms in this instance are shown as molded parts of the spacer body but may be attached with springs or other flexible material permitting the arms to open. The end wall of the slidable spacer 104 is the surface that bears against the outside surface of the earring. As in FIG. 19, slidable spacer 105 may be a plug with no springable arms with or without a location channel 106 for alignment in capsule 40.

Figure 8:
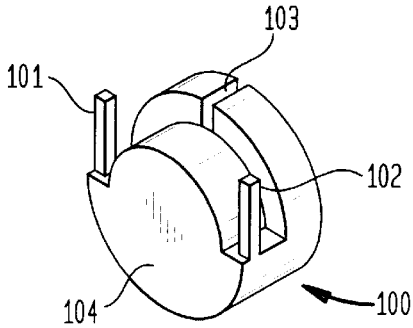
FIG. 8 is a perspective view of the slidable spacer.
Figure 8A:
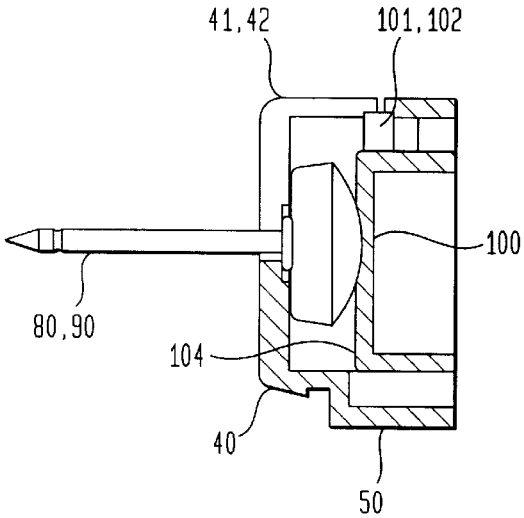
FIG. 8A is a side sectional view of the assembled capsule, earring and spacer.

FIG. 8A shows a partial cross section of the assembly of the capsule 40, earring 80 or 90, and slidable spacer 100 in alignment with doors 41 and 42 in the closed position. Arms 101 and 102 of the spacer 100 are compressed closed by the action of doors 41 and 42.

Figure 9:
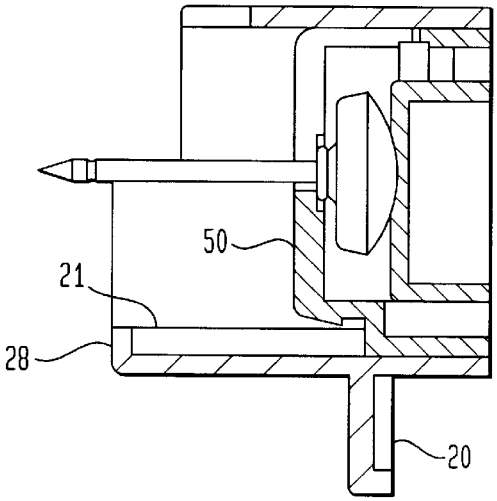
FIG. 9 is a side sectional view of the assembled outer cartridge, inner capsule, earring and spacer.

FIG. 9 shows the insertion of the sub-assembly 50 of the spacer 100 and capsule 40 into outer cartridge 20 with the point of the earring in the direction of the ear and slidable spacer 100 in position to apply force to the head of the earring to horizontally align the earring, with doors 41 and 42 compressed by the inside bore 21 firmly securing the earring post.

Figure 11:
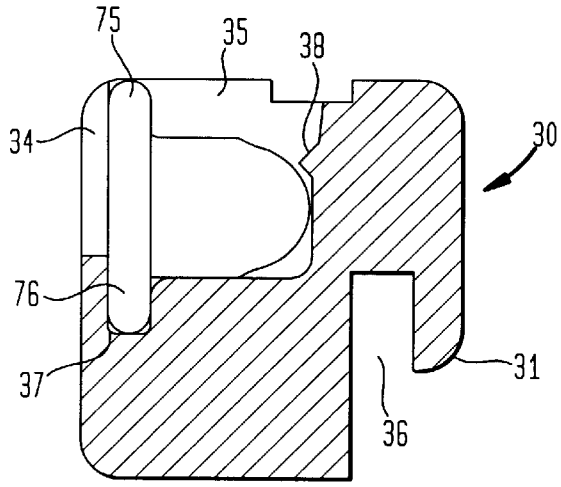
FIG. 11 is a side sectional view of the clutch cartridge holding a closed end clutch.
Figure 12:
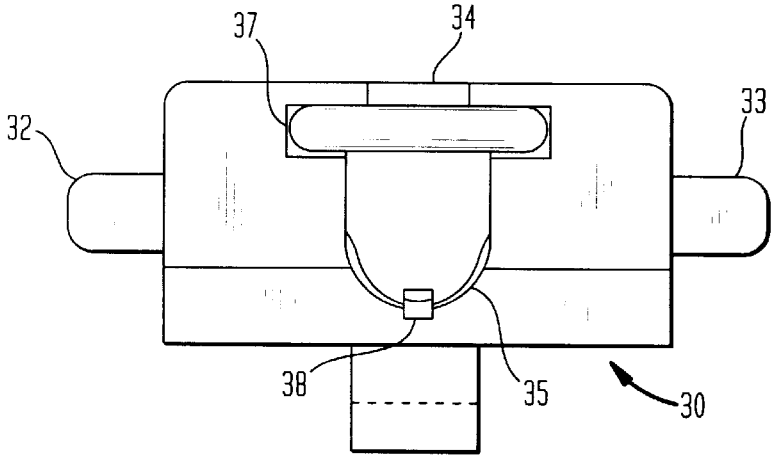
FIG. 12 is a plan view of the clutch cartridge containing the closed end clutch.

Clutch holder 30, FIGS. 11,12,13 and 14, illustrates the pocket 35 into which the clutch will enter. Retainer 31 in conjunction with channel 36 are inserted in the clutch holder bracket 11 and stopped by a shelf 12, FIG. 17. This aligns the clutch centerline with that of the cartridge centerline. Clutch holder 30 is constructed with opening 34 through which the earring point must pass to enter the hole in the clutch. Pocket 35 includes an additional channel 37 into which the large flange 76 of the clutch resides, as shown in FIG. 11. A cantilevered retainer rib 38 provides a retention force to hold the clutch in position for shipping. When the earring post enters the clutch and moves forward, the rib 38 will yield allowing the clutch 75 to be released. FIG. 12 shows a plan view of the cartridge.

Figure 13:
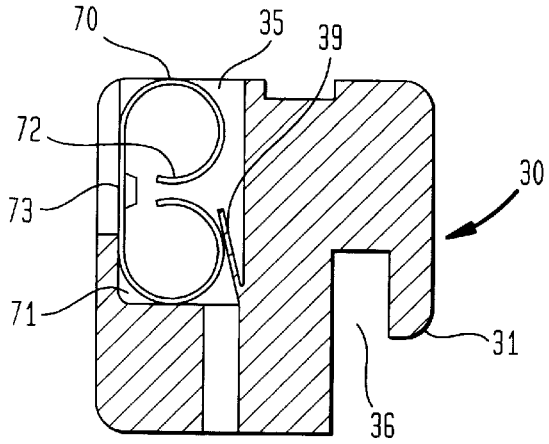
FIG. 13 is a side sectional view of the clutch cartridge holding a spring arm clutch.
Figure 14:
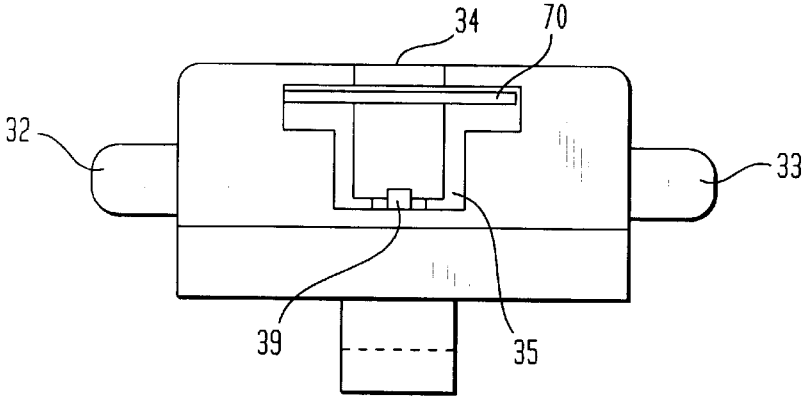
FIG. 14 is a plan view of the clutch cartridge holding the spring arm clutch.

FIG. 13 shows a clutch 70 that is constructed with circular spring arms 71 which provide a locking force against the earring posts undercut. Surfaces 72 are spaced apart such that the larger diameter earring post spreads the surfaces apart which then firmly attach to the undercut on the post. The opening of clutch 70 is provided with a tapered entry 73 to direct the point to the locking surfaces 72. Rib 39 is provided to retain clutch 70 and when the earring has moved forward, rib 39 is released to allow the clutch to exit the clutch holder. Rib 39 may be frangible to break when compressed by the earring and release the clutch with no resistance upon completion of the piercing. FIG. 14 shows a plan view of the clutch cartridge.

Figure 5:
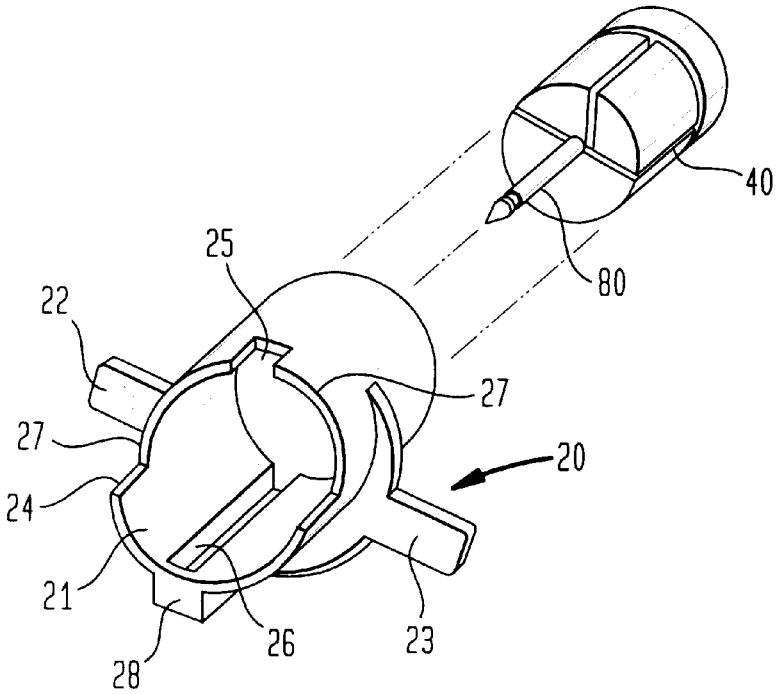
FIG. 5 is a perspective view of the capsule and earring head positioned for insertion into the outer cartridge.
Figure 17:
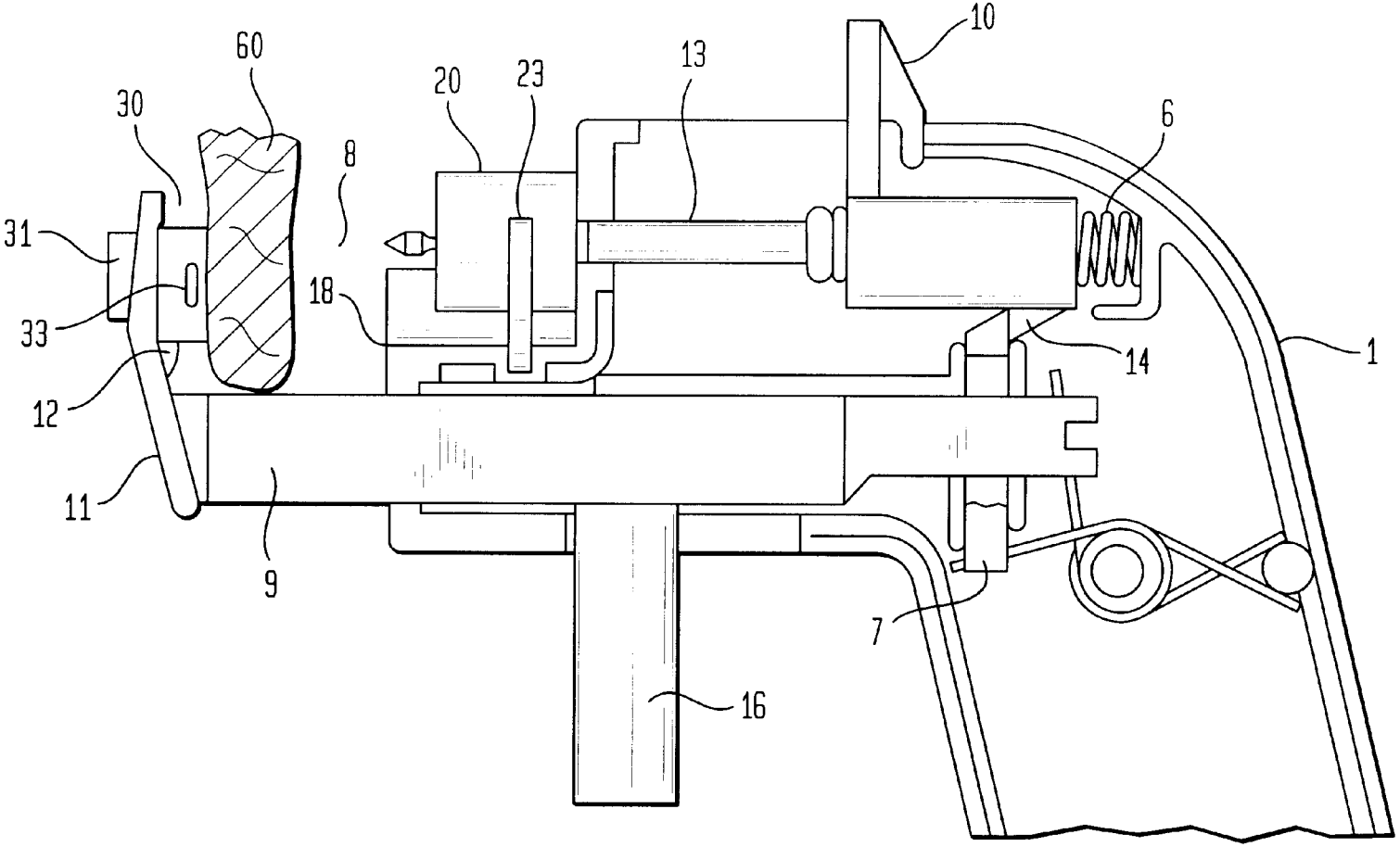
FIG. 17 is a side partial sectional view of the instrument with cartridges inserted and an earlobe positioned for insertion of the earring by actuation of a cocked spring.
Figure 18:
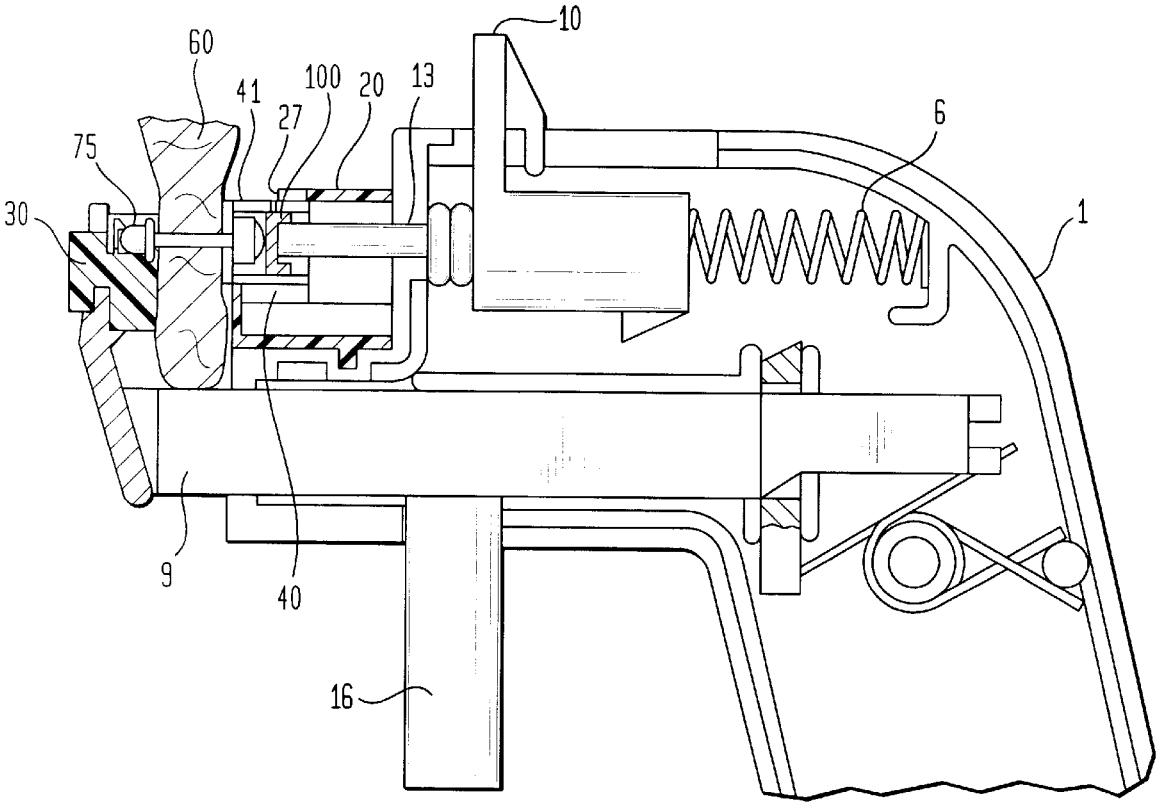
FIG. 18 is a side partial sectional view of the actuated instrument showing the ear lobe penetrated by the earring with the clutch positively engaged.
Figure 19:
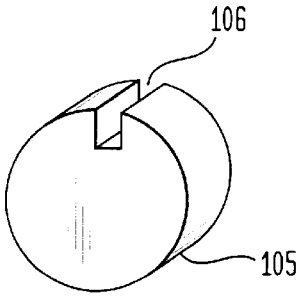
FIG. 19 is a perspective view of a slidable spacer without operating spring arms.

As shown in FIGS. 2 and 17, the earring cartridge 20 and clutch holder cartridge 30 are in position in the instrument 1, with the ear lobe 60 to be pierced located in the saddle region 8 of the instrument. The operator will view the point of the earring in the aperture 25 of the capsule 20, shown in FIG. 5. Prior to insertion of the capsule, the instrument 1 is operated by applying a rearward pull force to the top finger knob 10 attached to the plunger 13 which becomes spring biased to provide the necessary insertion force to penetrate the ear. The instrument internal mechanism is shown in the sectional side view of FIG. 17. Upon biasing spring 6, a locking sear 7 will retain plunger 13 with a sear stop 14 maintaining the plunger in a ready condition. The biased spring 6 can now propel the earring through the ear lobe 60 and thence into the clutch. The penetration commences upon the operator squeezing the trigger 16, retracting the clutch holder 30 towards the ear lobe 60. Sear 7 which restrains plunger 13 is then released to drive the plunger forward into the cartridge 20, forcing the inside surface of slidable spacer 100 to advance the earring and capsule 40 towards the ear. The earring passes through the ear lobe 60 and into the clutch 75 until the point of the earring 84 has reached its travel limit as determined by the extension of plunger 13. Stop 28 which closes the end of channel 26, serves to limit the outward travel of the capsule, as shown in FIG. 5. Capsule 40 provided with rib 46, shown in FIG. 7, will terminate at the inside wall of stop 28, preventing over travel of the capsule. FIG. 18 depicts the completed operation prior to the doors 41 and 42 being opened in the cartridge 20. The doors 41 and 42 will now open by the upward force exerted upon the inside walls of 41 and 42 by the spring arms 101 and 102 of the slidable spacer 100, as shown in FIGS. 7 and 8. Hinged doors 41 and 42 now in the open position allow end walls 49 of the capsule to clear the cut back surfaces 24 and abutting walls 27 of the cartridge, as shown in FIG. 5. Spring arms 101 and 102 being in the vertical position abut surface 27 of the cartridge and are held in this open position. Sufficient clearance is provided by the cartridge for the hinged doors and large decorative earring heads. The head of the earring is now released from between face 104 of spacer 100 and the inside wall of the capsule 44 by lowering the instrument down. An alternative slidable spacer 105, as shown in FIG. 19, without spring arms will not apply an opening force to the doors. However hinges 45 are sufficiently thin and flexible to permit the head of the earring to open the doors with minimal effort. Channel 106 of spacer 105 is slidable in capsule 40 and prevents the spacer from becoming askew.

Figure 10:
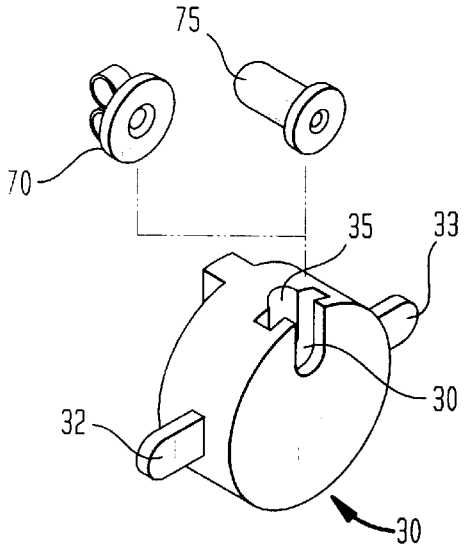
FIG. 10 is a front perspective view of the clutch cartridge with clutches to be inserted.

The clutch holder 30 containing the clutch 70 or 75 will permit the clutch to be removed from the chamber 35 as the retaining ribs 38 or 39, as shown in FIGS. 10,11 and 13, are displaced backward and will no longer retain the clutch. Lowering the instrument then clears the ear lobe 60 and attached earring and clutch. The plunger 13 now needs to be retracted back into the instrument 1 by a rearward pull on finger knob 10.

The cartridge 20 is removed from the instrument 1 by gripping and lifting ears 22 and 23 upward and then discarded.

The clutch holder 30 is removed from the instrument 1 by gripping and lifting ears 32 and 33 upward from the bracket and discarded.

The process may be duplicated for additional piercings.

It is understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. An earlobe piercing device comprising:

a housing including a handle at one end;

a trigger assembly extending outwardly from said handle, said assembly including a movable longitudinal extension member and a transverse trigger member;

a spring biased plunger positioned within said handle along said extension member;

a biasing member connected to said plunger and extending from said handle for biasing said plunger in a holding position;

a clutch holder bracket mounted at the outer end of said extension member;

earring cartridge retaining channels positioned on said housing in the path of said spring biased plunger; an open area between said clutch holder bracket and earring cartridge channels for receiving an earlobe;

a clutch holder cartridge insertable into said clutch holder bracket;

an earring cartridge insertable into and retained within said earring cartridge retaining channels;

said earring cartridge including a first hollow tubular member and an inner tubular capsule receivable and movable within said first tubular member and means for aligning said inner capsule within said first tubular member, means for retaining an earring and post within said capsule including a tubular slidable spacer receivable and movable within said capsule and means for aligning said spacer within said capsule, and means on said inner capsule for releasing said earring following movement of said capsule into said open area toward said clutch holder cartridge;

contraction of said trigger member releasing said spring biased plunger from said holding position to project said capsule into said open area toward said earlobe and clutch holder cartridge.

2. The device of claim 1 including a clutch insertable into said clutch holder cartridge and an earring having a head and a post insertable into said earring cartridge inner capsule, wherein said first hollow member is cylindrical, said inner capsule being hollow and cylindrical with an opening at one end, a first end wall at the opposite end of said capsule enclosing a portion of said opposite end and including pivotable side walls having end wall portions, said side and end wall portions being foldable together with said first end wall to enclose said inner capsule within said first cylindrical member in said holding position, said first end wall including a central notch for receiving an earring post;

said slidable spacer having spring arms extending upwardly at opposite sides of said spacer, said arms being foldable downwardly on said spacer within said capsule in said holding position and being released to urge said pivotable side walls into an open position upon movement of said capsule into said open area.

3. The device of claim 2 wherein said first hollow cylindrical member includes side walls having openings, said pivotable side walls of said inner capsule opening into said side walls openings of said first hollow cylindrical member upon movement of said capsule into said open area, said first hollow cylindrical member including a pair of extensions at opposite sides for positioning and retaining said earring cartridge in said earring cartridge retaining channels, and a central channel in a lower wall portion for aligning said inner capsule, said inner capsule having a lower rib engageable with said central channel.

4. The device of claim 3 wherein said slidable spacer includes a cylinder having a front end with a reduced peripheral portion providing a clearance area, said spring arms extending from the sides of said peripheral portion and being foldable into said clearance area in said holding position, and a slot in an upper rear portion of said cylinder, said inner capsule having an internal rib on an upper interior surface engageable with said slot in said slidable spacer for alignment therewith, said earring head being positioned in said inner capsule between said front end of said inner spacer cylinder and the back of said end wall of said capsule with said earring post extending through said end wall notch.

5. The device of claim 4 wherein said clutch holder cartridge includes an upper channel having a central opening in the front face for receiving the post of the earring and a pocket for receiving the clutch, retaining means extending from the back wall of said pocket for retaining said clutch within said pocket in said holding position and being displaceable upon engagement of said post in said clutch to release said clutch, a pair of extension arms at opposite sides of said clutch cartridge for inserting and removing said clutch into and from said clutch bracket, and a retaining rib at the rear of said clutch cartridge for positioning said clutch cartridge in said clutch bracket.

6. The device of claim 5 wherein said clutch includes a front flange and a domed back, said clutch holder cartridge upper channel includes a first pocket of increased diameter for receiving the flange of the clutch and a second smaller diameter deeper extending pocket for receiving the back of said clutch.

7. The device of claim 5 wherein said clutch holder bracket includes a stop member for engaging said retaining rib for positioning said clutch cartridge in said clutch bracket.

8. The device of claim 5 wherein said clutch includes a pair of circular spring arms having a spacing therebetween for receiving and retaining an earring post, said retaining means within said clutch cartridge second pocket being a thin flexible member extending at an angle toward and engageable with one of said spring arms.

9. The device of claim 8 wherein said thin flexible member is frangible.

10. The device of claim 1 wherein said first hollow tubular member is non-cylindrical and said inner tubular capsule and slidable spacer are non-cylindrical and conformal.

11. The device of claim 1 wherein said slidable spacer is cylindrical and includes a slot in an upper surface, said inner capsule having an internal rib on an upper interior surface engageable with said slot in said slidable spacer for alignment therewith.

12. The device of claim 4 wherein said earring post is a straight cylinder having a pointed end and an undercut diameter spaced from the end and engageable with said clutch.

13. The device of claim 4 wherein said earring post has a first diameter cylindrical portion adjacent a pointed end including an undercut diameter spaced from the end for engagement with said clutch, and a second larger diameter cylindrical portion extending toward the earring head.

14. The device of claim 4 wherein said first hollow cylindrical member includes a central aperture in an upper wall portion for viewing the inner capsule and earring positions, and a stop member at the end of said central channel in the lower wall portion to limit movement of said inner capsule.

15. The device of claim 1 including locking means for retaining said spring biased plunger in a holding position.

16. An earlobe piercing device for securing an earring and clutch to an earlobe comprising:

a housing including a handle at one end;

a trigger assembly extending outwardly from said handle, said assembly including a movable longitudinal extension member and a transverse trigger member;

a spring biased plunger positioned within said handle along said extension member;

a biasing member connected to said plunger and extending from said handle for biasing said plunger in a holding position, and locking means for retaining said plunger in said holding position;

a clutch holder bracket mounted at the outer end of said extension member;

earring cartridge retaining channels positioned on said housing in the path of said spring biased plunger;

an open area between said clutch holder bracket and earring cartridge channels for receiving an earlobe;

a clutch holder cartridge insertable into said clutch holder bracket, said clutch holder cartridge including an upper channel having a central opening in the front face for receiving a clutch, retaining means extending from a back wall of a pocket for retaining said clutch within said pocket, a pair of extension arms at opposite sides of said clutch cartridge for inserting and removing said clutch into and from said clutch bracket, and a retaining rib at the rear of said clutch cartridge for positioning said clutch cartridge in said clutch bracket;

an earring cartridge insertable into and retained within said earring cartridge retaining channels, said earring cartridge including a first hollow cylindrical member and an inner hollow cylindrical capsule receivable and movable within said first cylindrical member and means for aligning said inner capsule within said first cylindrical member, said inner capsule having an opening at one end, a first end wall at the opposite end of said capsule enclosing a portion of said opposite end and including pivotable side walls having end wall portions, said side and end wall portions being foldable together with said first end wall to enclose said inner capsule within said first cylindrical member in said holding position, said first end wall including a central notch for receiving an earring post;

means for retaining an earring having a head and post within said capsule including a cylindrical slidable spacer receivable and movable within said capsule and means for aligning said spacer within said capsule, and means on said inner capsule for releasing said earring following movement of said capsule into said open area toward said clutch holder cartridge, said slidable spacer having spring arms extending upwardly at opposite sides of said spacer, said arms being foldable downwardly on said spacer within said capsule in said holding position and being released to urge said pivotable side walls into an open position upon movement of said capsule into said open area, said slidable spacer including a cylinder having a front end with a reduced peripheral portion providing a clearance area, said spring arms extending from the sides of said peripheral portion and being foldable into said clearance area in said holding position, and a slot in an upper rear portion of said cylinder, said inner capsule having an internal rib on an upper interior surface engageable with said slot in said slidable spacer for alignment therewith, an earring head being positioned in said inner capsule between said front end of said inner spacer cylinder and the back of said end wall of said capsule with an earring post extending through said end wall notch, said first hollow cylindrical member including side walls having openings, said pivotable side walls of said inner capsule opening into said side walls openings of said first hollow cylindrical member upon movement of said capsule into said open area, said first hollow cylindrical member including a pair of extensions at opposite sides for positioning and retaining said earring cartridge in said earring cartridge retaining channels, and a central channel in a lower wall portion for aligning said inner capsule, said inner capsule having a lower rib engageable with said central channel, contraction of said trigger member releasing said spring biased plunger from said holding position to project said capsule into said open area toward said earlobe and clutch holder cartridge.

* * * * *